US006108911A

United States Patent [19]

Hoch

[11] Patent Number: 6,108,911

[45] Date of Patent: Aug. 29, 2000

[54] HAND PROPELLED THROWING PROJECTILE

[76] Inventor: Clyde D. Hoch, 313 Fourth St., Pennsburg, Pa. 18073

[21] Appl. No.: 09/350,334

[22] Filed: Jul. 9, 1999

[51] Int. Cl.[7] ..... F41B 13/00

[52] U.S. Cl. ..... 30/123; 30/344; 473/578

[58] Field of Search ..... 473/578, 585, 473/FOR 216, FOR 220; 30/123, 342, 344

[56] References Cited

U.S. PATENT DOCUMENTS

| | | | |
|---|---|---|---|
| 619,762 | 2/1899 | Kissinger et al. | 473/585 |
| 2,087,445 | 7/1937 | Price . | |
| 2,109,120 | 2/1938 | Price . | |
| 2,213,637 | 9/1940 | Osgood . | |
| 2,693,361 | 11/1954 | Hay | 473/585 |
| 2,753,860 | 7/1956 | Schanz . | |
| 2,816,765 | 12/1957 | Stockfleth | 473/583 |
| 3,424,460 | 1/1969 | Simpson | 473/578 X |
| 3,772,781 | 11/1973 | Newman . | |
| 3,790,948 | 2/1974 | Ratkovich . | |
| 4,621,817 | 11/1986 | Musacchia . | |
| 4,940,246 | 7/1990 | Stagg . | |
| 5,197,745 | 3/1993 | Whitely . | |
| 5,636,845 | 6/1997 | Newnam | 473/583 |
| 5,642,565 | 7/1997 | Tovar Riestra | 473/578 X |

*Primary Examiner*—John A. Ricci
*Attorney, Agent, or Firm*—Jeffrey T. Spangler

[57] ABSTRACT

This invention discloses an improved configuration for a hand propelled throwing projectile, combining elements of a throwing knife, a spear, a dart and an arrow. It includes a sharpened and pointed blade, a flight-stabilizing conical tail of flexible filaments, a rigid shaft between the blade and tail, and a blade holder between the blade and shaft which has a mass in relation to the entire projectile so that the projectile's center of gravity is located within the grip portion of the blade holder, which is contoured for gripping and throwing by at least two fingers. The projectile is thus gripped at its center of gravity, and the thrower's kinetic energy is imparted to it in the most efficient manner, as if the entire projectile were a mass point. The projectile is more easily thrown with accuracy and more reliably impaled in its target by users with minimal training and experience than a traditional throwing knife.

6 Claims, 1 Drawing Sheet

HAND PROPELLED THROWING PROJECTILE

BACKGROUND OF THE INVENTION

1. Field of the Invention

This invention is an amusement and exercising device, relating to arrows and darts. It is an improved variant of a throwing knife.

2. Description of the Related Art

From the prehistoric era, humans have fashioned projectiles with sharpened points to be thrown by hand and impaled within a target, used as a weapon to hunt animals for subsistence or in armed combat, or for recreational purposes. Examples include spears, arrows, knives with blades having one or more edges, darts, and variations such as throwing stars. Each projectile requires a slightly different technique for propelling it through the air in a particular trajectory with sufficient force and accuracy to pierce and remain impaled in the target.

Objectives for recreational projectiles have been the ease with which they may be thrown accurately by users with limited training and experience, and the reliability with which they hit and remain in the target. Physical principles which govern such projectiles include location of the center of gravity, distribution of mass along the axis, means for stabilizing it while in flight, and creation of enough momentum to pierce and impale the target. An ideal projectile is gripped and thrown at its center of gravity.

SUMMARY OF THE INVENTION

The present invention is a hand thrown blade which may be easily and accurately thrown and impaled in a target by users with little or no training and experience. It has sufficient mass to provide the momentum necessary to pierce and remain impaled in a target, a flight-stabilizing tail to maintain its trajectory while in flight, a distribution of mass which optimizes the energy imparted to the blade upon release, and a contoured grip for the fingers to make throwing easier and more efficient. The point at which it is gripped and thrown is located at the center of gravity of the projectile, so that virtually all of the kinetic energy delivered by the thrower at the point of release is imparted to the blade for its forward motion, maximizing its momentum along its trajectory for accuracy and piercing of the target, and minimizing its loss of energy as angular momentum from rotation about the center of gravity.

DETAILED DESCRIPTION OF THE INVENTION

Figure 1:
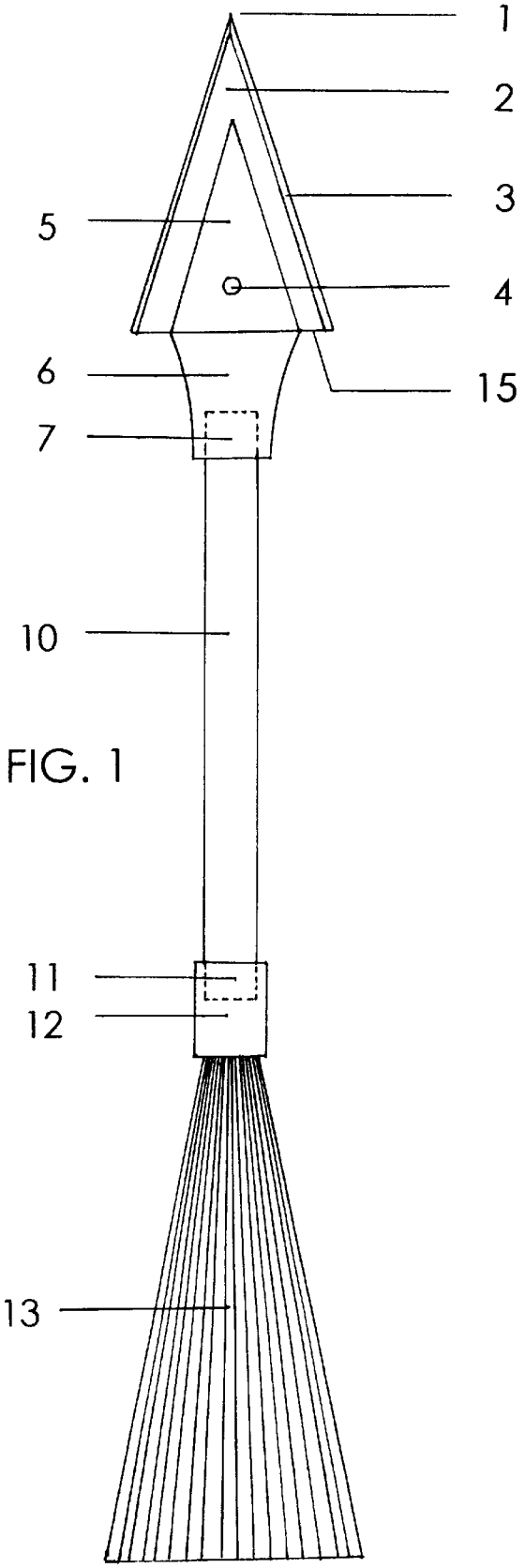
FIG. 1 is the assembled projectile, which is radially symmetrical around a linear axis except for a planar blade, in a view perpendicular to the blade.
Figure 2:
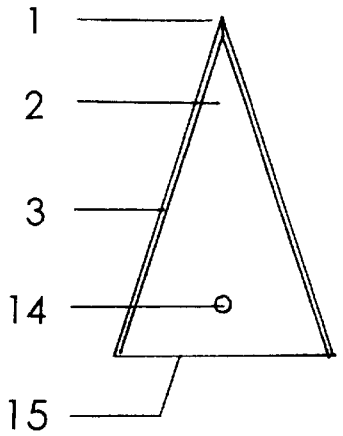
FIG. 2 is a view of the planar blade.
Figure 3:
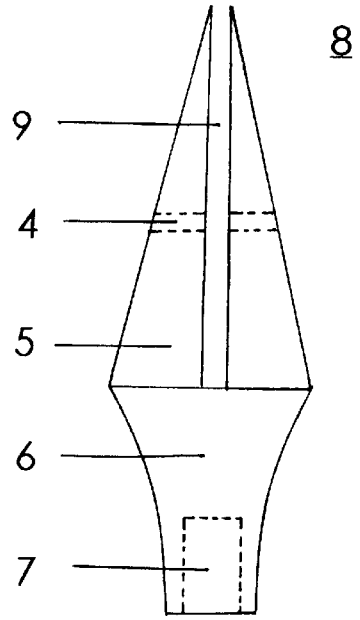
FIG. 3 is a view of the blade holder in the plane of the slot which holds the blade, a plane which includes the linear axis of the projectile.

The central element of this invention is the blade holder 8, which serves several functions. It provides a means by which the sharpened blade 2 may be gripped and thrown without cutting the thrower; it constitutes a majority of the mass of the projectile, which if thrown with sufficient kinetic energy will have adequate momentum to travel along its intended trajectory to the target, as well as to pierce and remain in the target upon impact; and most importantly, it establishes the center of gravity of the projectile within the tapered grip portion 6 of the blade holder 8, so that all or most of the kinetic energy delivered by the thrower upon release of the projectile is transferred to the blade for forward motion along its trajectory to the target, most effectively using the center of gravity as a mass point gripped by the thrower.

In the preferred embodiment of this invention, the blade holder 8 is machined from a single cylindrical piece of brass. The blade end 5 of the blade holder 8, conical in shape, is formed with a saw-cut slot 9 along the axis of the cylinder and of the same thickness as the blade which it will hold. A first aperture 4 is drilled through the blade end 5 of the blade holder 8, perpendicular to its axis and of sufficient diameter to accept a setscrew, spring or other means used to firmly fix the blade to its holder. The first aperture 4 must be threaded if a setscrew is used as the means of attachment.

The grip end 6 of the blade holder 8 is tapered from the base of the conical blade end 5 to provide a comfortable and efficient surface for gripping and throwing using two or more fingers. In the preferred embodiment, the grip end 6 is tapered in the opposite direction from the conical blade end 5, and it is contoured similarly to the hyperbolic cooling towers of nuclear power plants. Its surface is axially tapered to accommodate the finger surfaces of the thrower as they grasp the projectile, and to prevent the fingers from sliding forward toward the base of the blade 2. Such slippage may be further prevented by putting a knurled pattern onto the grip end 6, or by using other means to roughen its surface, such as sandblasting or etching.

A first bore 7 is formed along the axis of the grip end 6 opposite the blade end 5 to accept the blade end of the shaft 10. If this junction is to be threaded, as in the preferred embodiment, the first bore 7 in the grip end 6 must be threaded to receive the threaded blade end of the shaft 10. All rough edges of the blade holder 8 are deburred after its fabrication is completed.

The blade 2 should be of relatively small mass in relation to the entire projectile, and should be sufficiently sharpened and pointed to assure impalement and retention in the target. While it may have only one sharpened edge 3 with a point 1, in the preferred embodiment it is much more likely to pierce a target when formed with two edges 3 which converge in a point 1.

Stainless steel is a lightweight and durable material which holds an edge well, and is used for the blade 2 in the preferred embodiment of this invention. For simplicity of manufacture by known methods in the metal-forming arts, the blade 2 is formed as an isosceles triangle from a sheet of hardened stainless steel, with a second aperture 14 being placed along the altitude of the triangle to receive a setscrew or spring which fixes the blade 2 within the slot 9 in the blade holder 8. The equal sides of the blade are sharpened to a point 1. The base of the isosceles triangle, which is the trailing edge 15 of the blade, is not sharpened.

To stabilize the projectile while in flight, it is provided with a tail 13 to enhance its aerodynamic performance by reducing drag, maintaining it on its trajectory, and absorbing turbulence which may deflect it from the intended flight path. Various types of tails have been employed in the prior art, including rigid or flexible fins such as the plastic or feather vanes used in the game of throwing darts at a bull's-eye target, and streamers made of cloth.

The preferred embodiment of this invention instead uses a tail 13 having a conical array of flexible thermoplastic filaments in the form of a brush, with the apex of the cone directed toward the blade 2. These filaments are fixed in a cylindrical tail holder 12, also preferably of a lightweight thermoplastic material, by a suitable adhesive such as epoxy cement. The tail holder 12 is provided with a second bore 11 to receive the shaft 10, which is attached with a suitable adhesive for the materials to be joined.

The shaft 10 is formed from a solid cylinder of rigid, lightweight thermoplastic material, with the tail end being cut perpendicular to its axis to fit into the second bore 11 of the tail holder 12 where it is secured with an adhesive, and the blade end being threaded to be screwed into the threaded first bore 7 in the blade holder 8. The shaft 10 is of sufficient length to comfortably separate the blade 2 and blade holder 8 from the tail 13, but its length depends upon the dimensions of the grip end 6 of the blade holder 8, and the overall distribution of mass along the projectile so as to maintain its center of gravity within the grip end 6.

The projectile is preferably thrown in the manner of a dart or a spear, by gripping the grip end 6 of the blade holder 8 with two or more fingers, usually including the thumb and index finger, which are thus situated at the projectile's center of gravity. In this optimal method of throwing, all of the thrower's kinetic energy is delivered at the point of release to the center of gravity, and little if any of the energy is used to create rotation around the center of gravity, as is the case with a traditional throwing knife having a blade and handle. A traditional knife is usually thrown by gripping the blade and making the knife rotate end over end while in flight, with the point hopefully perpendicular to the target surface upon impact. Considerable training and experience is usually required to throw a traditional throwing knife with consistent accuracy, to achieve the precise amount of rotation so that the knife point is perpendicular to the target.

This invention may also be thrown in the manner of traditional throwing knives, by carefully gripping the blade 2 or blade holder 8 with two or more fingers, and creating rotation of the blade's point 1 and the tail 13 around the center of gravity, but this method reduces the momentum which is achieved upon impact, as well as the likelihood that the projectile will be sufficiently perpendicular to the target surface upon impact to pierce it and remained impaled.

Variations in the length of the shaft 10, the relative mass of the projectile's elements, and the precise location of the center of gravity within the grip end 6 of the blade holder 8 will affect the accuracy and reliability of the projectile when thrown by the preferred and traditional methods. For recreational users with limited training or experience in throwing projectiles, however, the preferred embodiment thrown in the preferred manner is significantly more likely to be thrown with accuracy and to remain impaled within the target than traditional throwing knives.

I claim:

1. A hand propelled throwing projectile comprising a blade having at least one sharpened leading edge, an unsharpened trailing edge and a point;

a blade holder having a blade end and a grip end; the blade holder having a mass in relation to the mass of the entire projectile so that the projectile's center of gravity is located within the grip end of the blade holder;

means for fixedly attaching the blade to the blade end of the blade holder;

a flight-stabilizing tail;

a rigid linear shaft having two ends, the one end being fixedly attached to the grip end of the blade holder, and the other end being fixedly attached to the flight-stabilizing tail; and means for attaching the one end of the shaft to the grip end of the blade holder, and means for attaching the other end of the shaft to the tail.

2. The projectile of claim 1, wherein the tail comprises a plurality of flexible filaments in a conical array, with the apex of the conical array being oriented in the same direction as the point of the blade; and wherein the blade is planar with two sharpened leading edges converging in a point.

3. The projectile of claim 2, wherein the projectile is radially symmetrical along its length, except for the blade.

4. A hand propelled throwing projectile comprising a rigid linear shaft, having a blade end and a tail end;

a blade having at least one sharpened edge and a point;

a blade holder having a blade end, a grip end, and a slot in the blade end for fixedly attaching the blade; the blade holder having a mass in relation to the mass of the entire projectile so that the projectile's center of gravity is located within the grip end of the blade holder; the grip end of the blade holder having a contoured surface for gripping and throwing of the projectile with at least two fingers;

means for fixedly attaching the blade within the slot in the blade holder;

means for fixedly attaching the blade end of the shaft to the blade holder;

a flight-stabilizing tail; and means for fixedly attaching the tail to the tail end of the shaft.

5. The projectile of claim 4, wherein the tail comprises a plurality of flexible filaments in a conical array, with the apex of the conical array being disposed at the tail end of the shaft, and oriented in the same direction as the point of the blade; and wherein the blade is planar with two sharpened edges converging in a point.

6. The projectile of claim 5, wherein the projectile is radially symmetrical along its length, except for the blade.

* * * * *